United States Patent [19]

Werner

[11] 4,005,591

[45] Feb. 1, 1977

[54] BALL SIZING MACHINE AND METHOD

[75] Inventor: John A. Werner, Milwaukee, Wis.

[73] Assignee: Besser Industries, Inc., Roanoke, Ill.

[22] Filed: Feb. 11, 1976

[21] Appl. No.: 657,178

[52] U.S. Cl. ..... 72/75; 72/370

[51] Int. Cl.[2] ..... B21B 17/06

[58] Field of Search ..... 72/75, 370

[56] References Cited

UNITED STATES PATENTS

| | | | |
|---|---|---|---|
| 3,587,269 | 6/1971 | Seccombe et al. | 72/370 X |
| 3,691,805 | 9/1972 | Gresham et al. | 72/75 |

*Primary Examiner*—Francis S. Husar
*Assistant Examiner*—John E. Roethel

[57] ABSTRACT

A ball sizing machine for sizing an internal passage in a workpiece in which pressure is employed to force a sizing ball through the passage against a fluid counter-pressure. The opposite ends of a passage to be sized are sealed at each end with a tapered ram plug with the sizing ball within the head end of the passage. The passage is filled with a fluid, such as oil, from the tail end of the passage. When passsage has been filled from the tail end to a predetermined pressure, the system is conditioned to permit a metered flow of fluid out of the tail end when pressure is applied to the head end of the passage in front of the ball to force the ball through the passage.

16 Claims, 7 Drawing Figures

BALL SIZING MACHINE AND METHOD

SUMMARY OF THE INVENTION

The present invention relates to ball sizing apparatus of the type wherein a hardened ball of precisely controlled dimensions is forced through a passage of slightly smaller diameter to enlarge the passage to close tolerances. Machines for performing this operation are commercially available and, in the usual case, include some mechanism for clamping or holding the workpiece in position while an elongated ram is employed to drive the ball from one end of the passage to the other. This arrangement, of course, requires a ram having a stroke at least equal to the length of the passage which is to be sized, thus presenting some practical limitations where passages of substantial length are involved. The present machine in the illustrated form thereof overcomes these limitations by employing fluid pressure as the medium to drive the ball through the passage, thus eliminating the need for long stroke rams, and further providing not only adequate lubrication for the ball within the passage, but also cushioning or minimizing jerkiness of the ball motion occasioned by variation in resistance encountered by the ball at various points along the passage and the compressibility of the fluid used for propelling the ball through the passage.

The embodiment of the invention illustrated takes the form of a machine having more or less conventional mechanism for indexing, aligning and clamping workpieces in position upon the machine. Two relatively short stroke hydraulic rams are positioned in alignment with opposite ends of the passage in a positioned workpiece to drive respective head and tail end sealing nozzles into seated engagement with the opposite ends of the passage. Movement of the head end nozzle into position is employed to drive the sizing ball into the head end of the passage.

Both the head and tail end nozzles are provided with internal passages so that fluid under pressure, such as oil, can be fed into the respective ends of the passage. A solenoid controlled hydraulic circuit is provided which, under the control of an electrical circuit will fill the passage from the tail end with fluid, such as oil, to a predetermined pressure upon the sealing of the opposite ends of the passage by the head and tail end nozzles. When the passage has been filled from the tail end, the hydraulic connections to the tail end nozzle are switched so that oil can be drained from the passage through the tail end nozzle through a restricted orifice. At this time, oil under a predetermined pressure is supplied to the head end nozzle and the differential pressure across the ball drives the ball from the head end of the passage to the tail end. When the ball arrives at the tail end nozzle, it effectively seals this nozzle and the resultant pressure drop in the external hydraulic circuit is employed to initiate a drain and workpiece release and replacement cycle. Alternatively a poppet type vent valve in the plug is opened by the arrival of the ball to create the pressure drop.

Other objects and features of the invention will become apparent by reference to the following specification and to the drawings.

IN THE DRAWINGS

Figure 3:
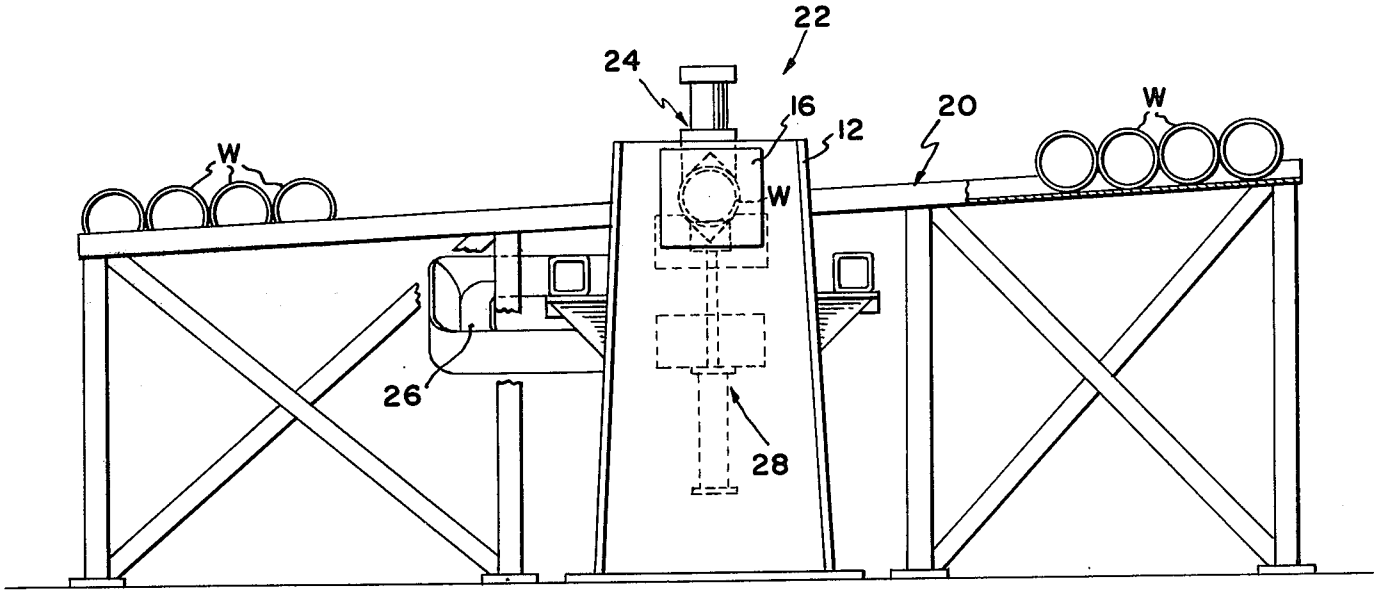
FIG. 3 is an end view of the apparatus of FIG. 1.
Figure 4A:
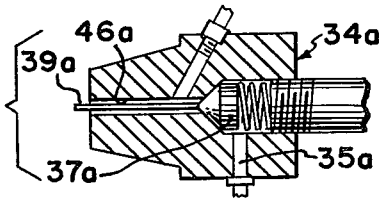
FIG. 4 is a cross sectional view through a workpiece showing the head and tail end nozzles seated.
Figure 4:
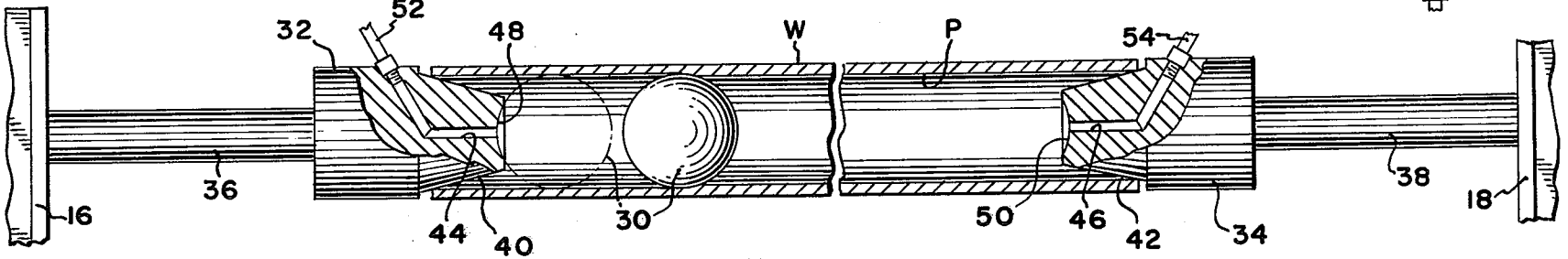
Figure 5:
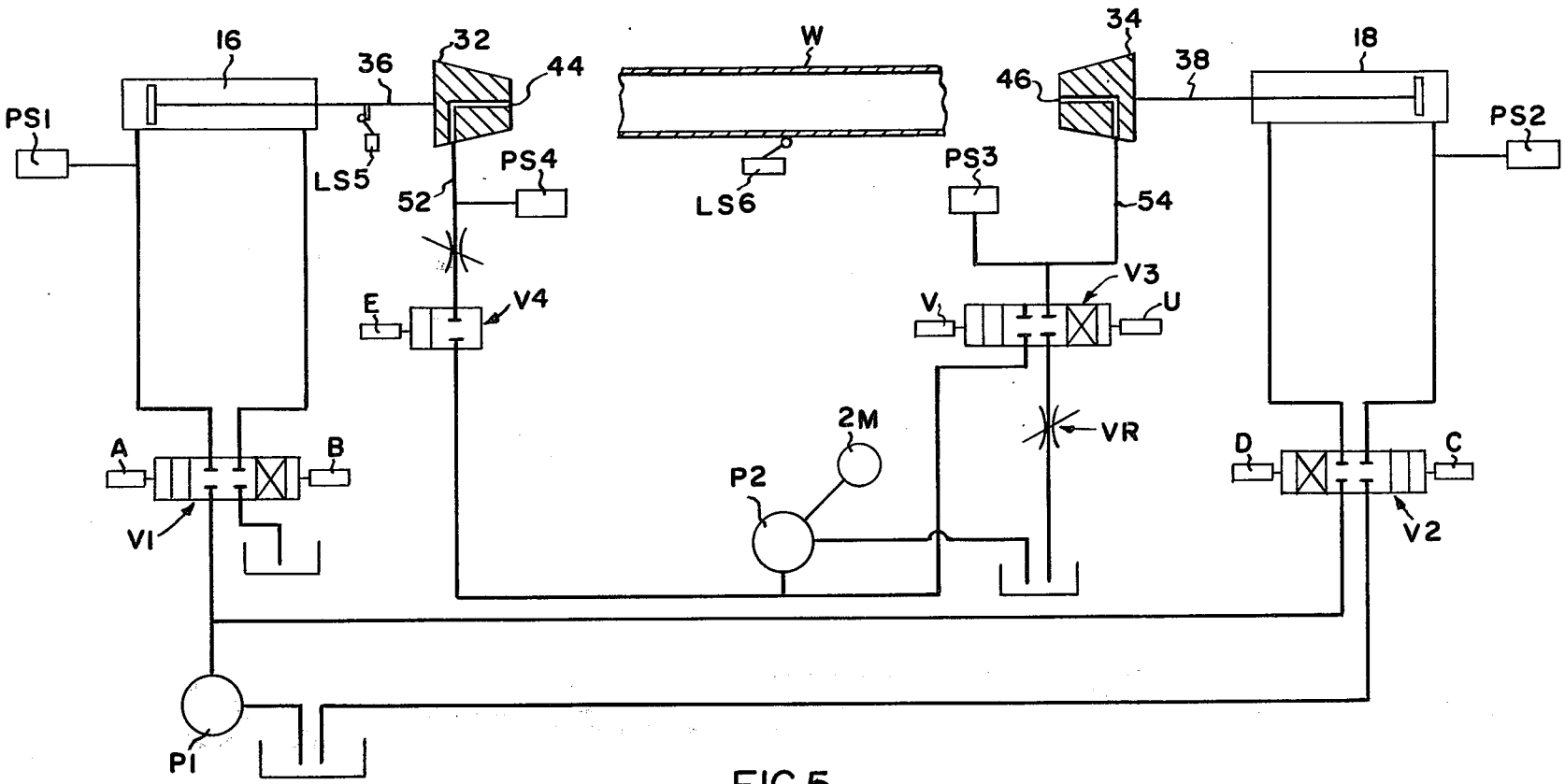
Figure 6:
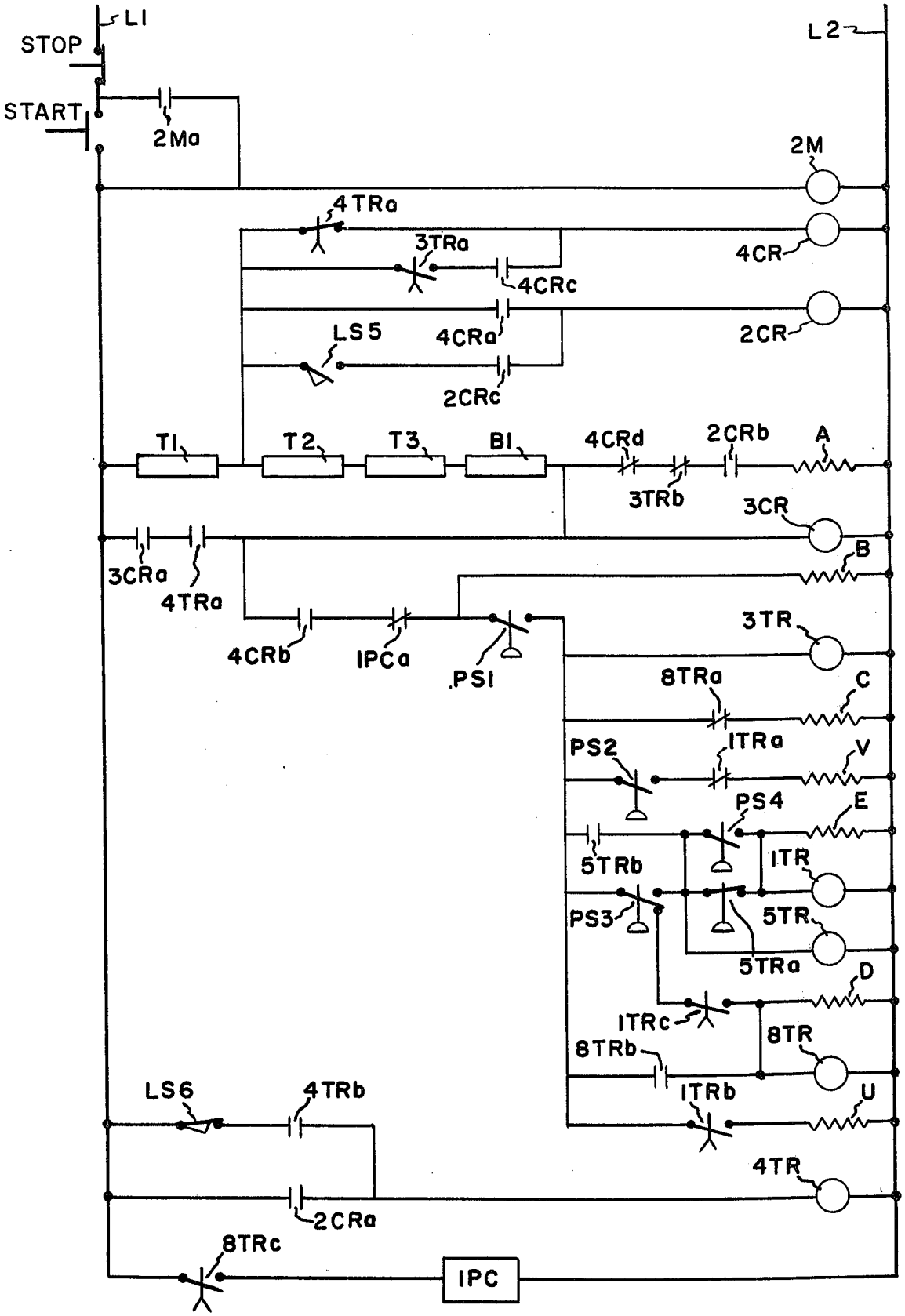

FIG. 4*a* is a cross sectional view of a modified form of tail nozzle;

FIG. 5 is a schematic diagram of a portion of one form of hydraulic circuit for operating the apparatus of FIGS. 1–4; and FIG. 6 is a schematic electrical diagram showing a portion of one form of electrical control circuit for the apparatus of FIGS. 1–4.

The present invention is especially concerned with the electrically controlled hydraulic system employed to force the sizing ball through a workpiece passage. In view of the fact that many commercially available or well-known workpiece handling devices operable to present a workpiece to the ball feeding apparatus of the present invention are known, the workpiece handling apparatus has been illustrated only generally in the drawings and will be but briefly described.

The apparatus includes a frame designated generally 10 which includes head and tail end pedestals 12 and 14 respectively which mount head and tail hydraulic rams or motors 16 and 18, respectively. Extending between pedestals 12 and 14 is a workpiece handling rack 20 which, as best seen in FIG. 3, is inclined downwardly from one side of the apparatus to the other to provide a gravitational feed for tubular workpieces W. Located centrally of table 20 is a workpiece holding station designated generally 22 (FIG. 3) which includes various clamping assemblies 24 operable to receive and clamp a workpiece W with the axis of the workpiece passage in coaxial alignment with the head and tail end rams 16 and 18. Also included, but not shown in the drawings, is a suitable indexing mechanism operable to release a single workpiece from the uphill side (right-hand side as viewed in FIG. 3) of table 20, align the workpiece with the various clamping mechanisms 24 and to eject the workpiece following the sizing operation to the downhill (or left-hand side as viewed in FIG. 3) of the table 20. Mechanism of this type is well-known in the art and is not directly related to the present invention other than performing its conventional feeding, aligning and ejecting functions.

Figure 1:
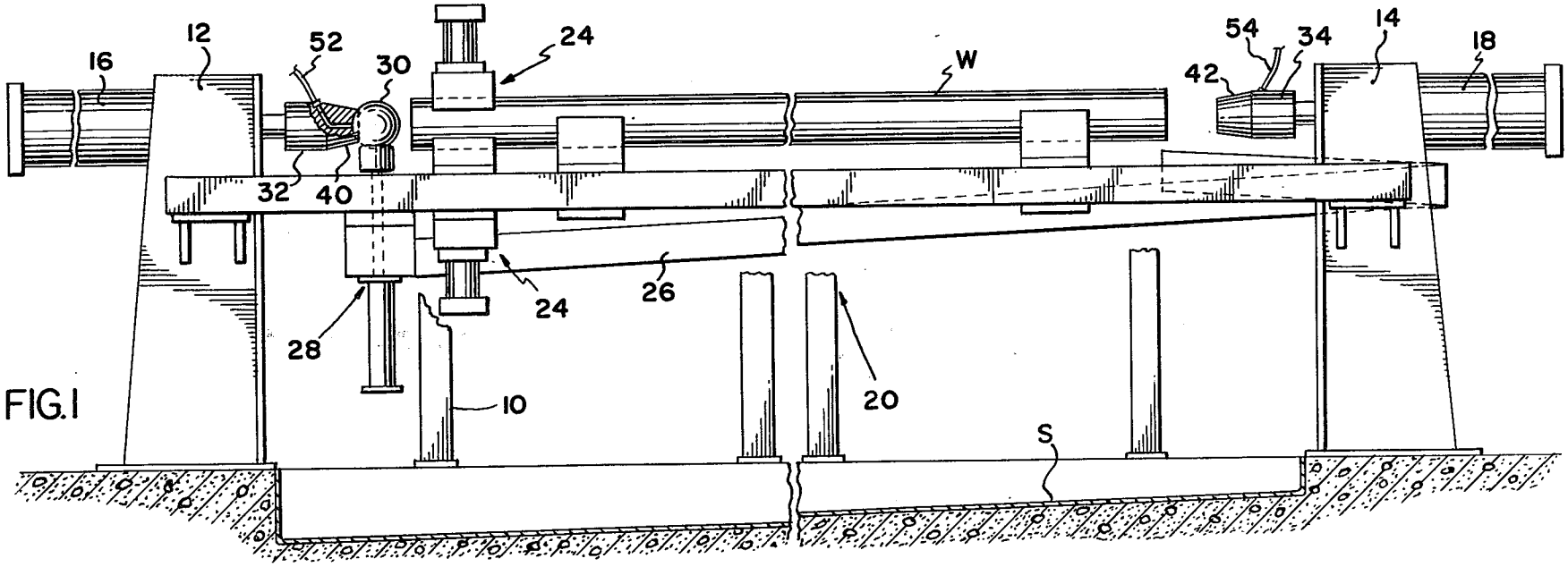
FIG. 1 is a side elevational view of an apparatus embodying the present invention with certain parts broken away or omitted.
Figure 2:
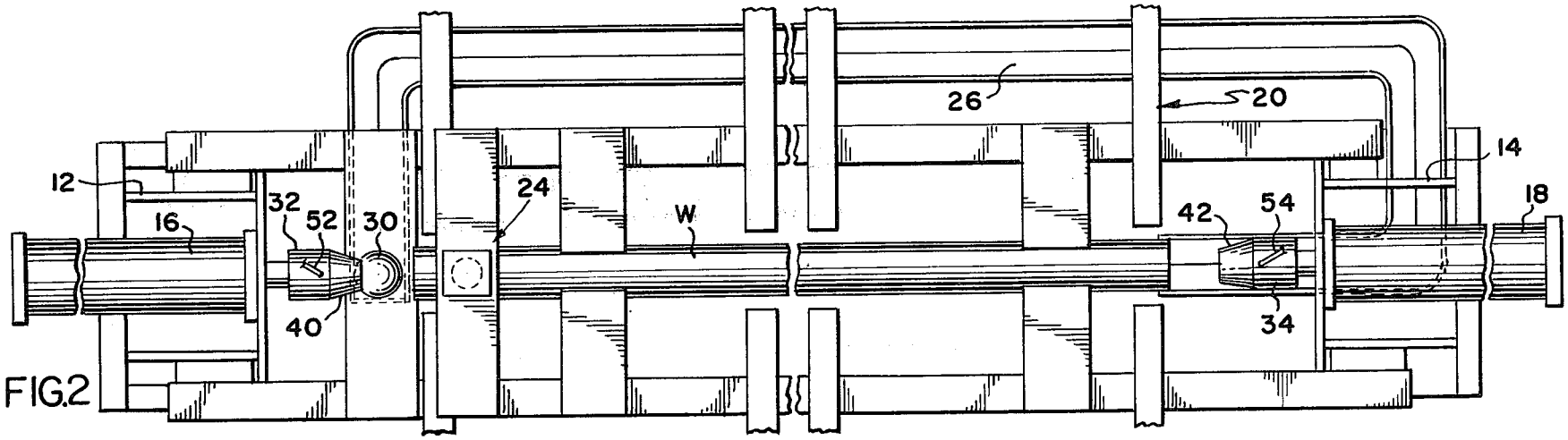
FIG. 2 is a partial top plan view of the apparatus of FIG. 1, with certain parts broken away or omitted.

The apparatus further includes a ball return chute 26 which gravitationally returns a ball from the tail end of the machine to the head end, a ball raising mechanism designated generally 28 being employed to elevate the ball 30 from chute 26 into alignment with a positioned workpiece as shown in FIG. 1.

Referring now particularly to FIG. 4, it is seen that each of the head and tail stock ram motors 16 and 18 carries a frustoconical sealing nozzle 32 and 34 upon the respective head 36 and tail 38 piston rods. Each nozzle 32 and 34 includes a frustoconical sealing section 40, 42 dimensioned to sealingly engage the opposite ends of the passage P in workpiece W. Each nozzle 32, 34 further is formed with an internal passage 44, 46 located to open centrally into passage P, the nozzles each having a recess 48, 50 dimensioned to seat against ball 30. External conduits 52, 54 are hydraulically connected to passages 44, 46 respectively.

An alternative form of tail stock nozzle 34*a* is shown in FIG. 4*a*. Nozzle 34*a* is of the same overall configuration as nozzle 34 except that nozzle 34*a* is formed with a vent passage 35*a*. A spring loaded valve 37*a* normally seals the main passage 46*a* from vent passage 35*a*. The stem 39*a* of valve 37*a* projects from passage 46*a* to unseat valve 37*a* when ball 30 arrives at the tail end of the passage.

Referring now to the hydraulic diagram of FIG. 5, it is seen that hydraulic rams 16 and 18 have their rod and head ends hydraulically connected to the sump and output of a pump P1 via respective solenoid actuated four-way reversing valves V1 and V2. Valves V1 and V2 are commercially available three-position valves spring biased to a centered blocking position as shown in FIG. 5 when neither of their two controlling solenoids are energized.

An entirely separate hydraulic circuit is connected to the head and tail end nozzle passages, this circuit being supplied with fluid under pressure from a second pump P2 driven by a motor 2M. Tail end nozzle 34 finds its passage 46 connected via external conduit 54 selectively to the output or sump of pump P2 by a three-position four-way reversing solenoid valve V3 of construction similar to valves V1 and V2. The passage of head end nozzle 32 is connected only to the output of pump P2 via a simple solenoid operated on-off valve V4 and a flow control valve V5.

The circuit includes four pressure switches identified as PS1, PS2, PS3, and PS4. Pressure switch PS1 senses the pressure at the head end of ram 16 and is set to be closed when the pressure in the head end of the cylinder of ram 16 reaches a pressure evidencing the fact that the head nozzle 32 is fully seated, as shown in FIG. 4, in the head end of a workpiece passage P. The pressure switch PS2 similarly senses pressure at the head end of ram 38 and closes when the tail nozzle 34 is seated in the tail end of passage P.

Pressure switch PS3 is connected in the external circuit to tail nozzle passage 46 to close when pressure in this passage equals or exceeds a predetermined pressure. Pressure switch PS4 is similarly connected to sense the pressure in external conduit 52 connected to passage 44 in head nozzle 32.

The hydraulic circuit of FIG. 5 includes various pressure regulators, filters, variable restrictions, etc. which have not been illustrated because their placement and functions in the circuit are well known to those skilled in the art. There is illustrated, however, a variable restriction VR in the sump connection to valve V3 which acts to provide a selected restriction to the flow of fluid from tail nozzle passage 46 to the sump when valve V3 is positioned to connect conduit 54 to the sump. Variable restriction Vr imposes a resistance to the flow of the fluid outwardly from the passage of a workpiece through passage 46 to thereby maintain a substantially constant pressure in passage 46 by limiting the rate at which fluid can flow through this passage. It can include a manually settable pressure relief and flow control valve which is openable to a greater or lesser degree.

In addition to the elements described above, two limit switches LS5 and LS6 are shown in FIG. 5. LS5 is located to have its striker engaged when piston rod 36 of head end ram 16 is in its retracted position, while limit switch LS6 is held closed while a workpiece W is in operative relationship with nozzles 32 and 34. The contacts of limit switch LS6 open when the workpiece W is ejected at the conclusion of the sizing operation.

Operation of the system and in particular the hydraulic circuit of FIG. 5, is best appreciated by a description of the operation of the electrical control circuit schematically shown in FIG. 6.

The circuit of FIG. 6 has been substantially simplified from the circuit employed in the actual apparatus in that only that portion of the circuit concerned with the automatic operation of the simplified hydraulic control circuit of FIG. 5 has been shown. In the circuit of FIG. 6 there appear various schematically illustrated elements, T1, T2, T3, B1 and 1PC which function primarily in conjunction with the operation of the tube handling mechanism to control various relays and solenoids not shown in FIG. 6. Element T1 in actuality is a set of limit switches which are closed when a workpiece is in position, elements T2 and T3 are closed when the workpiece is aligned and clamped, while element B1 is closed when a ball is raised to the position shown in FIG. 1. For purposes of description of the circuit of FIG. 6, it will be assumed that all of these latter elements are electrically closed at all times. Element 1PC is a printed circuit which, in terms of the operation of the circuit of FIG. 6 is germane only in that it opens a normally closed contact 1PCa to initiate the final stages of the sizing cycle.

To start a description of a cycle of operation, it will be assumed that the apparatus is set with a workpiece to be sized aligned and clamped in operative alignment with the nozzles, and that the hydraulic and electrical circuits of FIGS. 5 and 6 are in the condition shown — that is with piston rods 36 and 38 of rams 16 and 18 in their fully retracted position, with all valves in their blocking position as shown and all relays and solenoids deenergized. To commence a cycle of operation, the start button of the electrical circuit of FIG. 6 is depressed to close the start contacts, thereby energizing pump motor relay 2M to commence to drive pump P2. Relay 2M immediately closes its controlled lock-in contacts 2Ma which bypass the start button contacts and maintain the circuit energized upon subsequent release of the start button.

Because elements T1, T2, T3 and B1 are closed at this time, relay 3CR is energized immediately upon depression of the start button to close contacts 3CRa. At the same time, a cycle start relay 4CR is energized via normal closed delayed opening contacts 4TRa. Energization of relay 4CR in turn closes contacts 4CRa to energize relay 2CR, which in turn closes contacts 2CRa to energize timing relay 4TR.

Energization of relay 4CR also closes contacts 4CRb which complete a circuit to solenoid B of valve V1 which shifts this valve from its blocking position to a straight connection, placing the head end of head cylinder 16 in communication with the output of pump P1 and venting the rod end of ram 16 to cause the piston rod 36 of the head end cylinder to drive in a direction to seat head nozzle 32 in the head end of the passage P of the workpiece. Upon the seating of head nozzle 32 in the workpiece passage, pressure in the head end of head cylinder 16 builds up to close pressure switch contacts PS1, thereby simultaneously energizing timing relay 3TR and solenoid C of valve V2, solenoid C being energized via normal closed contacts 8TR*a*.

Energization of solenoid C positions valve V2 to connect the output of pump P1 to the head end of tail cylinder 18 via the cross connections of valve V2, thus causing the tail ram to extend to drive tail nozzle 34 into sealed seating engagement with the tail end of the passage in the workpiece. When tail nozzle 34 is seated, the pressure in the head end of the cylinder of ram 18 builds up to close the contacts of pressure switch PS2.

Closure of pressure switch contacts PS2 energizes solenoid V of valve V3 which shifts valve V3 to make the cross connections of this valve, thereby connecting passage 46 of tail nozzle 34 to the output of pump P2.

This latter connection conducts oil from pump P2 into the interior of the workpiece to fill the passage P, via conduit 46, from the tail end so that eventually the entire passage in front of ball 30 is completely filled with oil. When the filling of the passage from the tail stock end is completed, the pressure builds up until the contacts of PS3 (FIG. 6) are shifted from the position shown in FIG. 6 to close the contacts in circuit with normal closed contact 5TR*a* to thus simultaneously energize solenoid E of valve V4 and timing relays 1TR and 5TR. Relay 5TR is immediately locked in by closure of its contacts 5TRb. Contacts 5TR*a* are time delayed opening contacts and remain closed for a predetermined period after energization of relay 5TR and open at the conclusion of the predetermined time delay.

Energization of relay E shifts valve V4 to connect the head nozzle passage 44 to the output of pump P2 to thus conduct fluid under pressure into the passage at the head end side of ball 30.

At this time, solenoid D of valve V3 has been deenergized, immediately upon the energization of relay 1TR by the opening of normal closed untimed contacts 1TR*a*. At a predetermined time interval after the energization of relay 1TR, the timed delay closing contacts 1TR*b* of relay 1TR are closed to energize solenoid U of valve V3, thus shifting valve to connect passage 46 in tail nozzle 34 to sump via the variable restriction Vr. Contacts 1TR*c* also close at this time, however, this closure of contacts 1TR*c* does not immediately have any effect since these contacts are isolated from the hot side of the line by the fact that pressure switch PS3 is in the off normal position from that illustrated in FIG. 6.

As fluid under pressure is supplied to the head nozzle passage 44, pressure in this passage builds up to close pressure switch contacts PS4, thus locking in solenoids E and 1TR via both of the closed contacts 5TR*b* and PS3.

The pressure applied at nozzle 32 forces the ball 30 away from the head end of the passage toward the tail end, fluid being metered out of the tail end of the passage via passage 46 and the variable restriction VR. The restriction VR in effect establishes a differential pressure across the ball, permitting the ball to move toward the tail end of the passage at a controlled rate established by the rate at which restriction VR permits fluid to flow outwardly through passage 46 at a preset pressure.

When the ball arrives at the rail end of the passage, it seats in the recess 50 (FIG. 4) of tail nozzle 34, thus blocking communication between tail nozzle passage 46 and the interior of the workpiece passage. Variable restriction VR still accommodates flow from passage 46 to the sump S of pump P2 and thus pressure in external conduit 54 steadily drops to shift the contacts at pressure switch PS3 to the illusrated position shown in FIG. 6.

Where the modified form of tail nozzle 34*a* (FIG. 4*a*) is employed, the ball engages valve stem 39*a* to unseat valve 37*a*, connecting passage 46*a* directly to the sump of pump P2.

At this time, contacts 5TR*a* opened, however the shifting of the contacts of pressure switch PS3 do not effect the continued energization of solenoid E, and timing relays 1TR and 5TR because relay 5TR is locked in by its contacts 5TR*b*, while solenoid E and relay 1TR remain energized via contacts 5TR*b* and the closed contacts of pressure switch PS4. Pressure switch PS4 remains closed because fluid under pressure is still being supplied to the head nozzle since solenoid E remains energized.

When contacts PS3 return to the position shown in FIG. 6, contacts 1TR*c* are closed and hence the shifting of contacts PS3 energizes solenoid D of valve V2 and relay 8TR, energizing of relay 8TR closing its contacts 8TR*a* to lock in solenoids D and relay 8TR.

Energization of solenoid D shifts valve V2 to establish the straight-through connection of valve V2, thus connecting the rod end of tail ram 18 to its pump P1 causing the piston rod 38 or ram 18 to retract away from passage P in the workpiece. Because pressure is still being supplied to head passage 44, the ball 30 remains pressed against tail nozzle 34 and as nozzle 34 is retracted away from the workpiece, ball 30 follows tail nozzle 34 and begins to emerge from the workpiece passage. The oil is free to flow out of the workpiece passage to the recirculating pump sump S of pump P2 once the ball 30 emerges from the passageway.

As the ball 30 follows the retreating tail nozzle 34, the pressure within the workpiece passage begins to drop and the contacts of pressure switch PS4 open. Because contacts 5TR*a* are open at this time, opening of contacts PS4 deenergizes solenoid E of valve V4 to shut off the flow of fluid under pressure to head nozzle passage 44. Relay 1TR is simultaneously deenergized to open contacts 1TR*c* and 1TR*b*, opening of these latter contacts deenergizing solenoid U which permits valve V3 to shift to its centered blocking position. Opening of contacts 1TR*c* has no effect on solenoid B or relay 8TR, since these latter two elements are locked in via contact 8TR*a*.

A predetermined time after the initial energization of relay 8TR, contacts 8TR*c* close to energize a printed circuit amplifier 1PC. Energization of 1PC opens its controlled normally closed contacts 1PC*a* which breaks the entire circuit to solenoids B, C, V, E, and D and also breaks the circuit to relays 3TR, 1TR, 5TR and 8TR.

Referring now to the circuit to control relay 4CR, it is seen that this relay, assuming element T1 is closed, is energized either via contacts 4TR*a* or via the series connected contacts 3TR*a* and 4TR*c*. At this time, the delayed opening contacts 4TR*a* have long since opened (relay 4TR having been energized at the start of the cycle) so that, upon the opening of contacts 3TR*a* by the deenergization of relay 3TR, relay 4CR is deenergized. This action permits normal closed contacts 4CR*d* in the energizing circuit to solenoid A to close, and because contacts 3TR*b* close upon deenergization of relay 3TR and relay 2CR is still energized via the closed limit switch LS5 and contacts 2CR*c*, contacts 2CR*b* are closed, thus energizing solenoid A of valve V1. Energization of solenoid A shifts valve V1 to cross connect head ram 16 to its supply source P1 to cause the piston rod 36 of ram 16 to retract to withdraw head nozzle 32 from sealing engagement with the workpiece. This action continues until the retracting piston rod 36 actuates limit switch LS5 to its open position, thus deenergizing relay 2CR. Contacts 2CR*a* in the energizing circuit for relay 4TR are thus restored to their normal open position and upon subsequent ejection of the workpiece from the sizing station, limit switch contacts LS6 open to deenergize relay 4TR. This latter action opens contacts 4TR*a*, thus opening the circuit to solenoid A and relay 3CR to restore the circuit to the same condition as it was at the commencement of the sizing cycle, with all relays and solenoids at the circuit of FIG. 6 deenergized, with the exception of the pump motor relay 2M. Upon replacement, positioning and clamping of the next subsequent workpiece, the foregoing cycle will be repeated.

While one embodiment of the invention has been described in detail, it will be apparent to those skilled in the art that various modifications may be made. Therefore, the foregoing description is to be considered exemplary rather than limiting, and the true scope of the invention is defined in the following claims.

What is claimed is:

1. In a ball sizing machine wherein a ball is forced through a passageway in a workpiece to size the internal diameter of the passageway; the improvement comprising means for inserting said ball into a first end of said passageway, first and second retractable sealing means respectively engageable with said first and second ends of said passageway to seal the opposite ends of said passageway with said ball in said passageway adjacent said first end thereof, fluid pressure supply means, first means for filling said passageway with fluid from said supply means via second sealing means, second means responsive to the filling of said passageway by said first means for conducting fluid from said supply means at a given pressure into said passageway via said first sealing means and for draining fluid from said passageway via said second sealing means at a restricted rate to thereby establish a differential pressure in said passageway on opposite sides of said ball to drive said ball from said first end of said passageway to said second end, and third means responsive to the arrival of said ball at said second end of said passageway for retracting said sealing means from the respective ends of said passageway.

2. The invention defined in claim 1 wherein said sealing means each comprise a nozzle member conformed to sealingly seat in one end of said passageway, said nozzle member having a fluid flow passage therethrough located to communicate with said passageway when the nozzle member is sealingly seated in one end thereof.

3. The invention defined in claim 2 wherein said sealing means further comprise reciprocable hydraulic ram means mounting said nozzle members for movement into and out of sealing engagement with said passageway.

4. The invention defined in claim 3 wherein said second means comprises switch means movable to a closed position when the pressure in the passage in the nozzle member of said second sealing means exceeds a predetermined pressure, first valve means responsive to the closing of said switch means for connecting the passage in the nozzle member of said first sealing means to said supply means, a restricted vent means, and second valve means for connecting the passage in the nozzle member of said second sealing means to said restricted vent means subsequent to the closure of said switch means.

5. The invention defined in claim 1 wherein said third means comprises means defining an external flow passage having a restriction communicating with said passageway via said second sealing means, and control circuit means including a pressure responsive switch in said external flow passage between said second sealing means and said restriction, said ball upon arrival at said second end of said passage being operable to block communication between said passageway and said flow passage to actuate said pressure switch.

6. The invention defined in claim 5 wherein actuation of said pressure switch conditions said control circuit sequentially to:

1. retract said second sealing means from sealing engagement with said second end of said passageway;
2. discontinue the supply of fluid to said passageway via said first sealing means; and
3. retract said first sealing means from said first end of said passageway.

7. The invention defined in claim 1 wherein said third means comprises means defining an external flow passage having a restriction communicating with said passageway via said second sealing means, control circuit means including a pressure responsive switch in said external passage between said second sealing means and said restriction, a vent passage in said second sealing means, normally closed valve means in said sealing means operable when closed to isolate said vent passage from said passageway and said external passage and operable when opened to place said vent passage in communication with said passageway and said external passage, said normally closed valve means having a stem portion engageable by said ball when said ball arrives at said second end of said passageway to open said normally closed valve means to actuate said pressure switch.

8. The invention defined in claim 7 wherein actuation of said pressure switch conditions said control circuit sequentially to:

1. retract said second sealing means from sealing engagement with said second end of said passageway;
2. discontinue the supply of fluid to said passageway via said sealing means; and
3. retract said first sealing means from said first end of said passageway.

9. In a ball sizing machine wherein a ball is forced through a passageway in a workpiece to size the internal diameter of the passageway; the improvement comprising a head hydraulic ram and an opposed tail hydraulic ram, head and tail nozzle members respectively mounted on said head and tail rams for reciprocable movement into and out of sealing engagement with opposite ends of a passageway of a workpiece, flow passage means in each of said head and tail nozzle members respectively defining an external fluid connection to opposite ends of said passageway when said nozzle members are in sealing engagement therewith, fluid pressure supply means, and control means for selectively connecting said ram means and said flow passages to said supply means to sequentially:

1. actuate said ram means to move said nozzle members into sealing engagement with opposite ends of a workpiece passageway while forcing said ball into the head end of said passageway;
2. fill said passageway via the flow passage in said tail nozzle member;
3. force fluid at a predetermined pressure into said passageway via said head nozzle member while draining fluid from said passage via said tail nozzle member at a controlled rate; and 4. retract said tail nozzle member from sealing engagement with the tail end of said passageway upon movement of said ball into engagement with said tail nozzle.

10. In a sizing machine wherein a sizing member is forced through a tubular passageway in a clamped workpiece to size the internal surface of the passageway; the improvement comprising means for inserting said sizing member into a first end of said passageway and sealing both ends of said passageway, fluid pressure supply means connected to fill said passageway with fluid between the sealed ends thereof, and means operable after the filling of said passageway for forcing said sizing member in a direction from said first end to said second end while draining fluid from said passageway at a controlled rate to drive said sizing member from said first end of said passageway to said second end.

11. In a sizing machine; a frame; means thereon for clamping a workpiece having a tubular passageway open at its head and tail ends; means for supplying a sizing member of substantially the configuration of the passageway but of slightly greater size to the passageway; fluid pressure drive means creating a fluid pressure force on the sizing member tending to move the sizing member in the passageway from the head end toward the tail end in a sizing path of travel; and fluid pressure drive opposing sizing means creating a fluid pressure opposing force of lesser magnitude on the opposite side of the sizing member to control the rate of movement of the sizing member.

12. An improved method of sizing a passageway in a workpiece by moving a sizing member of substantially the configuration thereof, but of greater size, through it; the improvement comprising creating differential fluid pressure forces on opposite sides of the member which move the member at a controlled rate from the head end of the passageway to the tail end thereof.

13. The method defined in claim 12 wherein the tail end of the passageway is sealed and oil pressure is supplied to the passageway on the downstream side of the member to create one of said forces; the tail end of the passageway is vented at a restricted rate until the member approaches the tail end of the passageway; and then the seal at the tail end of the passageway is released to permit egress of the remaining oil and sizing member.

14. The method defined in claim 13 in which the force applied to the upstream side of the sizing member is fluid pressure generated.

15. A method of sizing a passageway in a workpiece comprising: moving a sizing member into the head end of the passageway; sealing an opposite portion of the passageway while filling the passageway downstream of the sizing member with a fluid under greater than atmospheric pressure, and applying a force to the sizing member on the upstream side thereof while venting the fluid at a restricted correlated rate to move the sizing member along the passageway at a controlled rate.

16. The method defined in claim 15 in which said fluid is recirculated oil.

* * * * *

UNITED STATES PATENT AND TRADEMARK OFFICE

CERTIFICATE OF CORRECTION

PATENT NO. : 4,005,591
DATED : February 1, 1977
INVENTOR(S) : John A. Werner

It is certified that error appears in the above-identified patent and that said Letters Patent are hereby corrected as shown below:

Column 3, line 51, change "Vr" to -- VR -- .

Column 5, line 34, change "Vr" to -- VR -- .

Column 5, line 56, change "rail" to -- tail -- .

Column 6, line 1, after "5TRa" insert -- have -- .

Column 6, line 19, change "or" to -- of -- .

Column 6, line 51, change "4TRc" to -- 4CRc -- .

Column 7, line 30, after "via" insert -- said -- .

Column 8, line 43, after "said" insert -- first -- .

Column 10, line 11, after "oil" insert -- under -- .

Signed and Sealed this

Twelfth Day of April 1977

[SEAL]

*Attest:*

RUTH C. MASON
*Attesting Officer*

C. MARSHALL DANN
*Commissioner of Patents and Trademarks*